US007856697B2

(12) United States Patent
Quimod

(10) Patent No.: US 7,856,697 B2
(45) Date of Patent: Dec. 28, 2010

(54) BUTTON WITH REMOVABLE FACE

(76) Inventor: John Quimod, 1413 Queen Anne Ave. N., #9, Seattle, WA (US) 98109

( * ) Notice: Subject to any disclaimer, the term of this patent is extended or adjusted under 35 U.S.C. 154(b) by 31 days.

(21) Appl. No.: 12/201,296

(22) Filed: Aug. 29, 2008

(65) Prior Publication Data

US 2009/0056082 A1 Mar. 5, 2009

Related U.S. Application Data

(60) Provisional application No. 60/969,459, filed on Aug. 31, 2007.

(51) Int. Cl.
*A44B 1/14* (2006.01)

(52) U.S. Cl. ..... 24/113 R; 24/113 MP; 24/114.9

(58) Field of Classification Search ..... 24/90.5, 24/113 R, 113 MP, 114.9
See application file for complete search history.

(56) References Cited

U.S. PATENT DOCUMENTS

| | | | | |
|---|---|---|---|---|
| 2,087,074 | A * | 7/1937 | Tucker | 24/113 MP |
| 3,715,781 | A * | 2/1973 | Salvatori | 24/114.9 |
| 4,899,556 | A * | 2/1990 | Ford | 63/14.1 |
| 4,959,890 | A * | 10/1990 | Pazurek | 24/113 MP |
| 5,542,157 | A * | 8/1996 | Herman | 24/113 MP |
| 6,588,067 | B2 * | 7/2003 | Efron et al. | 24/102 SL |

* cited by examiner

*Primary Examiner*—Robert J Sandy
(74) *Attorney, Agent, or Firm*—Black Lowe & Graham, PLLC

(57) ABSTRACT

Ornate buttons with replaceable button faces are described as being applicable for clothing and other purposes using buttons as closures or decorations. In a preferred form, the button includes an anchor and a housing that cooperate to secure the button to a section of fabric or other material. A removable button face is received within the housing and can be replaced with other button faces having different aesthetic appearances.

12 Claims, 3 Drawing Sheets

BUTTON WITH REMOVABLE FACE

PRIORITY CLAIM

This application claims the benefit of prior provisional application Ser. No. 60/969,459, filed Aug. 31, 2007, which is hereby incorporated by reference.

FIELD OF THE INVENTION

This invention relates generally to clothing, particularly including buttons for use with clothing.

BACKGROUND OF THE INVENTION

Buttons are the dominant form of securing clothing, and have been a commonly used ornate decorative element in the world of dress and fashion for hundreds of years. For many people a button is not only an element for securing clothing but also is an accessory of dress and even a fashion statement. In the latter regard, it is desirable not only that a button be highly attractive, but also that it coordinate or harmonize with the other articles of dress, such as a person's suit, shirt, jewelry, and accessories.

While some people wear the standard company-issued buttons on their dress or suit for all occasions without thought of replacement, others choose to remove the standard-issue buttons and replace them with more ornate and expressive buttons because coordination and appearance is important to them. Further, one particular style of button cannot possibly be acceptable for numerous different styles and levels of dress, from casual dress to business dress to formal dress. One set of buttons is also unlikely to match every different type of clothing or different fabrics. Notwithstanding the differences in button designs based on quality and appearance, the appearance of the button face itself often has the most immediate visual impact on suit and dress.

Although it is possible to purchase numerous different buttons for different situations and then to replace the buttons as desired, it is enormously impractical to do so, primarily because of the time and effort involved in removing and sewing new buttons in place.

SUMMARY OF THE INVENTION

The present invention includes interchangeable and upgradeable button faces, for example by providing a means in the form of button faces that can be inserted and placed securely on clothing with the aid of an attached housing unit, with the housing unit providing the ability to secure and release buttons of differing designs to suit any occasion. The housing unit of the button casing is configured to universally accept a variety of buttons produced by multiple designers and manufactures within limits of engineering requirements. In general, the housing is configured to removably receive and hold a button face in place, whereby any of a variety of button faces may be inserted, removed, and replaced with others.

In one example, one portion of the housing is generally cylindrical, having upwardly extending sidewalls terminating at a rim, with the rim including an interior lip. The button face is received within the interior of the cylinder where it is held in place by the lip. In other examples, the housing may be square or have any other peripheral shapes.

In yet other examples, the housing element is designed with a center hollow well in order to accept button faces having a complimentary stem to create a secure attachment. In this arrangement, the button faces may be frictionally secured to the housing.

In still other examples, the button and housing may include one or more magnets and cooperating ferromagnetic materials use to hold the button face within the housing.

In accordance with further descriptions of the various preferred examples of the invention discussed below, the present invention seeks to provide an alternative solution to the problem of establishing different appearances for a single suit or dress, in a simple, convenient, inexpensive manner which is also safe from risk and damage to clothing.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

In general, the present invention relates to a housing secured to a clothing item, with the housing being configured to accept a removably attached button face. In the preferred form, the button housing is permanently secured to the clothing item and includes a front surface that is sized and configured to serve as a button. In alternate forms, however, the housing may be securely but removably attached to the clothing item. When in place, the housing and button face together cooperate to form a button that may be urged through a button hole in order to join shirt or jacket halves, pocket closures, or other fabric and clothing items that may be secured by buttons.

While discussed generally as being applied to clothing items, it should be understood that the present invention may also be applied to other items using buttons as closure devices or decorative items, such as with purses, bags, belts, and other items. In each case, the button is secured to a section of material in which the material may be fabric, leather, fur, rubber, or any other synthetic or natural material that may be secured by a button. Accordingly, the scope of the invention is not intended to be limited by the discussion of the preferred embodiment with respect to an article of clothing.

Figure 1:
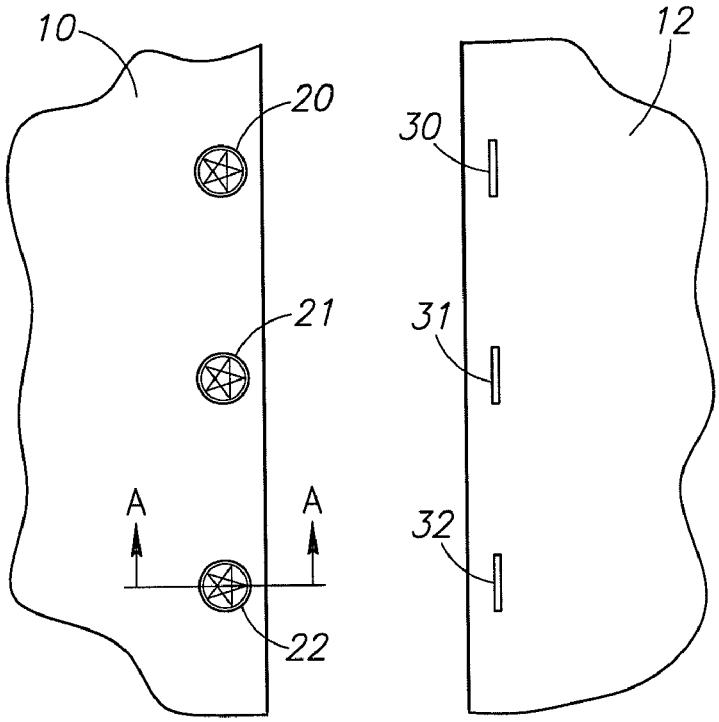
FIG. 1 is an exemplary view of a preferred button, shown as secured to an article of clothing.

An exemplary view of a preferred button, shown secured to an item of clothing, is illustrated in FIG. 1. As shown, the clothing item includes mating halves 10, 12 of a clothing item. The clothing item is shown in cut-away form, indicating that it may be any possible clothing item such as a shirt, jacket, pants, or others. A series of buttons 20, 21, 22 (each of which is the same as shown) are provided on one of the two mating halves 10, while a mating series of button holes 30, 31, 32 are provide on the other of the two mating halves 12. While three buttons and button holes are shown, any number is possible.

In accordance with the invention, one or more of the buttons 20, 21, 22 is secured to the clothing item so that the button face may be removed and replaced with a different button face, thereby changing the appearance of the button. Accordingly, buttons that are different in color or that have different facial insignia or designs can be readily secured to the clothing item while replacing the previously attached buttons.

Figure 2:
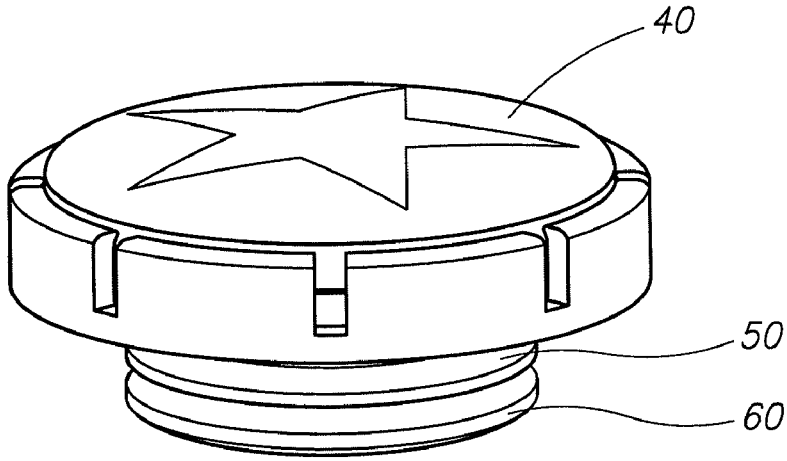
FIG. 2 is a perspective view of a preferred button, including a button face, housing, and anchor.

FIG. 2 is a perspective view of a preferred button, shown for clarity without being secured to a swatch of fabric or a clothing item. In the preferred form, the button includes a button face 40, a housing 50, and an anchor 60. As will be discussed in greater detail below, the button face 40 is principally for cosmetic purposes and is configured to be removably secured to the housing 50. As shown, the button face is generally in the shape of a circular disk as with conventional buttons, though it may alternatively have a different peripheral shape, consistent with the invention.

The housing 50 includes an upper portion that mates with the button face. When the button is generally circular, the housing likewise is configured to removably secure a circular button face. Preferably, the housing therefore includes an interior region that is cylindrical in shape so that it can receive the button face.

The housing 50 further includes a lower portion that provides a surface for engaging fabric. Preferably the upper portion is separated slightly from the lower portion, meaning that a spacer or other small segment is integrally provided between them. As shown, the surface is shaped as a circular flange of about the same diameter as the upper cylindrical portion, the circular flange extending radially outward from the center of the housing. In general, the flange is sized and shaped such that it can engage and hold the button securely against the fabric.

The anchor 60 likewise includes a surface for engaging the fabric, and as shown the surface is also in the form of a generally circular flange. The fabric of the shirt or other clothing item is sandwiched between the cooperating flanges of the housing 50 and the anchor, thereby holding the button to the fabric. As will be discussed below, the anchor preferably includes an upwardly extending stem that is received within the housing to hold the anchor and housing together in place.

In alternate examples, the anchor and housing need not be formed in two halves, but rather can comprise a single unit that is attached to the clothing item. In such an example, the housing may be stitched directly to the fabric, thereby eliminating the need for the anchor.

Figure 3:
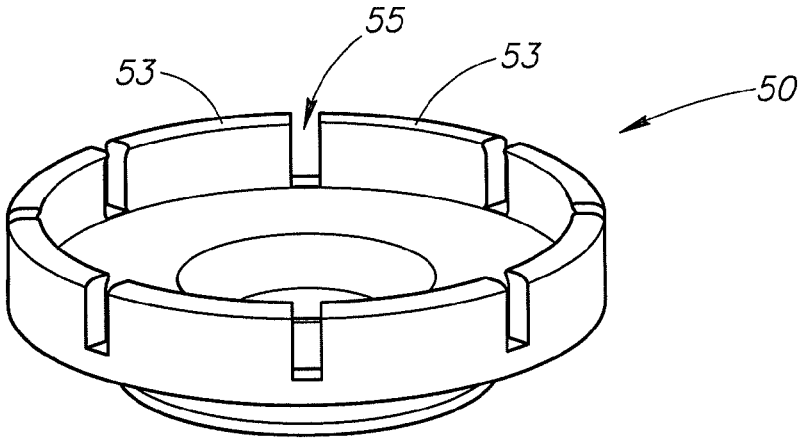
FIG. 3 is a perspective view of a preferred button housing.

FIG. 3 illustrates a preferred version of a button housing 50. As shown, the housing includes an upper portion defining an interior space for receiving a decorative button face. In the exemplary version, the interior space is configured as a short cylinder to receive a circular disk-shaped button. The upper cylinder portion includes upwardly-extending sidewalls formed by a series of petals 53 that are separated from one another, defining spaces 55 between petals 53. In addition, the floor section of the cylinder may be similarly segmented and include spaces between floor segments. The separations between the plurality of sidewall segments and the plurality of floor segments provides for a flexible housing, thereby making the button face easier to remove by allowing the user to distort the housing until the button face falls out. The button housing may be formed from metal, plastic, or other suitable materials, such that, in combination with the segments and spacings the housing is sufficiently rigid to hold the button face in place but sufficiently flexible to facilitate removal of the button face when desired.

Figure 4:
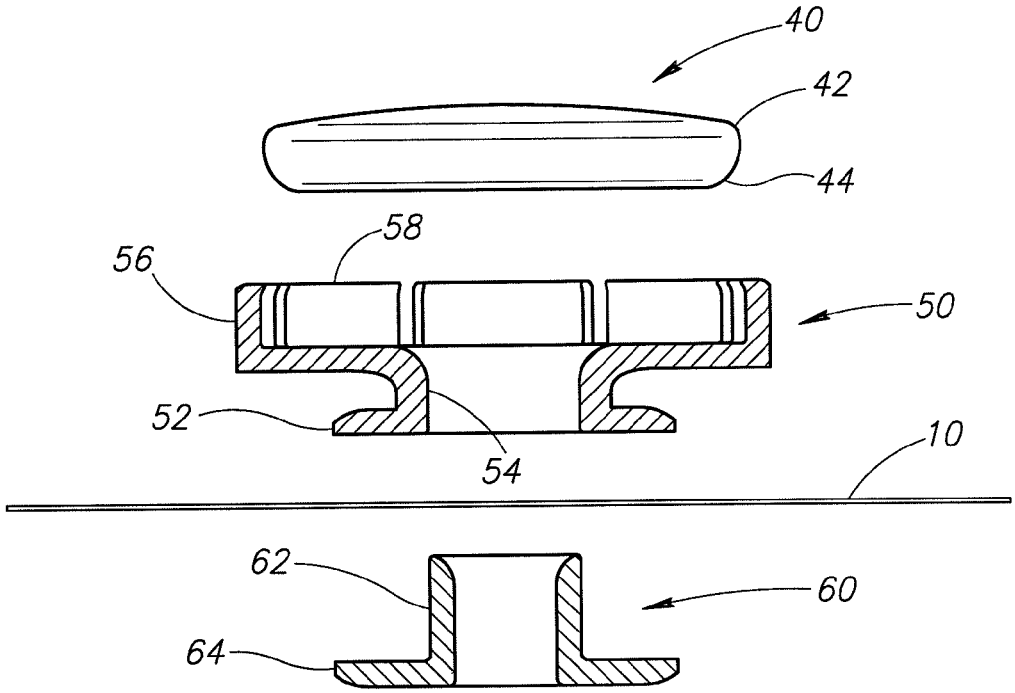
FIG. 4 is a cross-sectional view of a preferred button, taken along lines A-A in FIG. 1.

FIG. 4 is a cross-sectional exploded view of a preferred button, taken along lines A-A in FIG. 1. In the preferred example, the button includes a button face 40 that is received within a housing 50. The housing 50 and anchor 60 cooperate to hold the button to a section of fabric 10, sandwiching the fabric between the housing and anchor.

In this preferred example, the anchor 60 includes an upwardly-extending stem 62 having a base and an opposing tip, and a peripheral flange 64 surrounding the base of the stem. The flange is sized and shaped to be sufficiently large to hold the anchor against the fabric 10 so that the button is securely held to the fabric. As shown, the stem 62 is hollow. In the event a button face 40 is difficult to remove from the housing 50, a pin may be inserted through the stem to push against an inner surface of the button face to aid in removal. While the button stem is preferably hollow and includes an interior channel, in other versions it may be solid.

The size of the stem 62 is sufficient to pierce a swatch of fabric while being sturdy enough to support the housing. In one example, the stem is approximately 5 mm or less in diameter.

The preferred housing 50 includes a lower portion having a peripheral flange 52. The housing flange 52 is generally sized and shaped to substantially match that of the anchor flange, such that the two flanges cooperate to hold the fabric 10 between them. The housing flange surrounds the rim of a well 54 configured to receive the stem of the anchor. Thus, in use, the stem 62 pierces the fabric and is inserted into the well 54 such that the flange 52 of the housing and the flange 62 of the anchor sandwich the fabric 10 between them.

The outside diameter of the stem 62 and the inside diameter of the well 54 are designed such that the stem is snugly frictionally received within the well. In one example, the outside diameter of at least an upper portion of the stem 62 is slightly greater than the inside diameter of the well 54. Ideally the stem may be removed but a substantial force is required. The housing and anchor may be formed from any of a variety of materials, as noted above. In some versions one or both components are manufactured from plastics that are somewhat deformable to facilitate the friction fitting of the two pieces. In other versions, one or both components are made from metal.

While the preferred version includes a stem and well configuration that relies solely on friction fitting, in other examples of the invention additional structures are provided to provide an even more secure attachment of the housing to the anchor. Thus, for example, the stem and well may include ridges and cooperating channels or other such features.

As shown, the anchor is configured with an upwardly extending stem that is received within a well within the housing. In yet other examples of the invention, these two features may be reversed or otherwise configured. For example, the anchor may include a well or channel that receives a stem extending downward from the housing in order to secure the two components together. Still other configurations are also possible to join the two pieces in a manner that secures them to the fabric.

An upper portion of the housing 50 defines a shallow circular cylinder for receiving the button face. As described above, in one form the sidewalls 56 of the cylinder may comprise a plurality of petals separated by spaces to facilitate insertion and removal of the button face. As shown, one or more of the petals includes a lip 58 or other interior projection that secures the button face within the housing.

The button face 40 is illustrated as being a circular disk having sidewalls 44 that generally conform to the sidewalls 56 of the housing. An upper shoulder 42 is provided on the button face 40, with the shoulder being configured to cooperate with the lip 58 to hold the button face in place. The shoulder may be, for example, a recessed or tapered portion of the button face such that the shoulder can fit below the surface of the lip 58.

Figure 5:
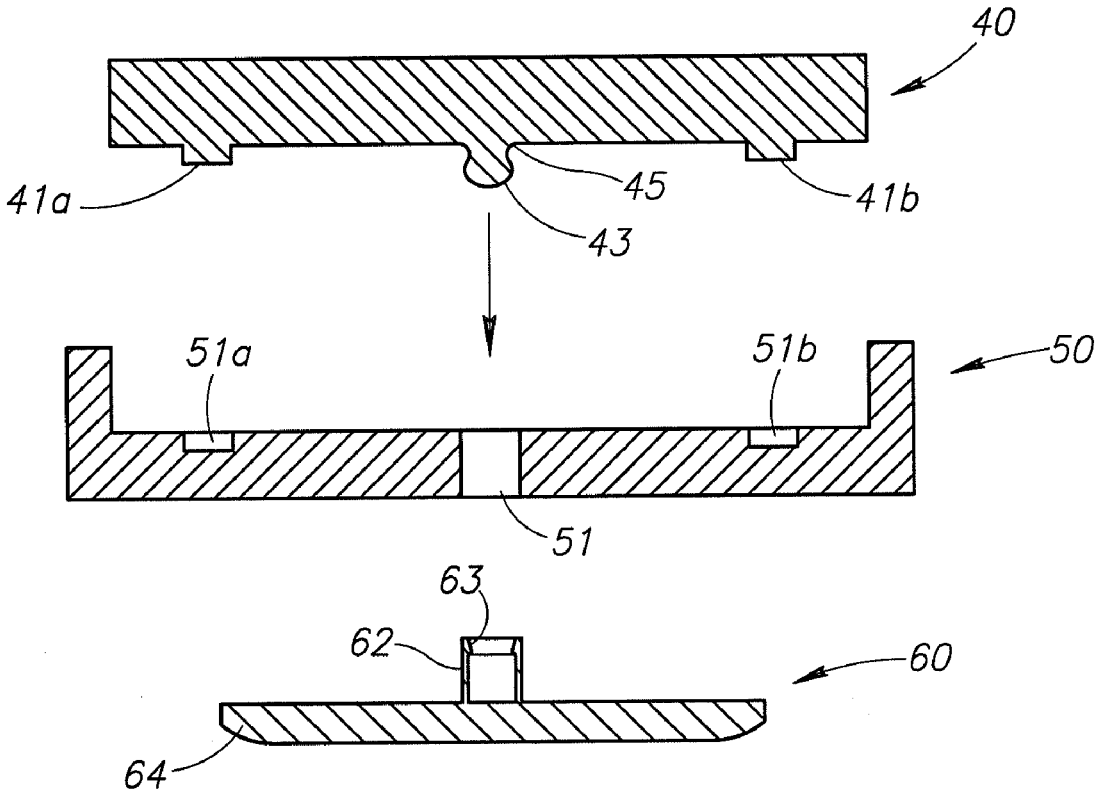
FIG. 5 is a cross-sectional view of an alternate preferred button.

In an alternate example of the invention, shown in FIG. 5, additional features may be incorporated to secure the button face to the housing, anchor, or both. Thus, as shown, the button face can optionally include one or more pegs 41*a*, 41*b* that mate with one or more slots 51*a*, 51*b* in the housing. In this alternate example, the housing lip may be eliminated, relying instead on the friction or snap-fit of the pegs within the slots to hold the button face in place.

In addition, or instead, the button face may also include a downwardly-depending central lobe 43, with the central lobe being sized and shaped to pass through the well 51 in the housing and to be inserted into a channel provided within the stem 62. The lobe 43 may include a narrowed base 45 that cooperates with an inwardly-extending rim provided within the channel in the stem 62 of the anchor, such that the lobe 43 is snap-fit into the anchor 60, thereby holding the button face 40, housing 50, and anchor 60 in place. Note that in this version the lower portion of the housing 50 may be eliminated.

In yet another version of the invention, the button includes a system of supporting internal magnets, rather than a lip and bevel system as described above. In a version using magnets, the magnetic components may be incorporated into many different locations within the scope of the invention. For example, the anchor, base, button, or button face (or any portion of the foregoing) may be formed from metal while one of the other components includes (in whole or in part) a magnetic component.

In accordance with the invention as described above, any of a variety of button faces may be inserted into a housing and later removed and replaced with other button faces. The button faces may be removed by flexing the housing, prying the button face from the housing, inserting a peg or pin through the channel in the anchor, or by any other suitable means. There is no limit to the number of different button faces a user can acquire and use. Furthermore, a user can easily design and make new button faces as desired.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

I claim:

1. A reconfigurable button, comprising:

an anchor having a stem with a base and a tip, the anchor further having a first flange extending radially outwardly from the base;

a housing having a lower portion comprising a well, the well being frictionally secured to the stem of the anchor to retain a section of material therebetween, the lower portion of the housing having a second flange extending radially about the well, the housing further having an upper portion defining an interior space, the upper portion of the housing being substantially cylindrical in shape, the interior space of the housing being defined by a floor and upwardly extending sidewalls, the sidewalls further comprising a plurality of upwardly extending petals; and a button face, the button face being removably retained within the interior space of the housing.

2. The button of claim 1 wherein the floor comprises a plurality of separated sections.

3. The button of claim 1 wherein the upper portion of the housing is flexible.

4. The button of claim 1 further comprising a projection formed on the sidewalls and extending into a center of the interior space.

5. The button of claim 1 wherein each of the plurality of petals comprises a bottom adjacent the floor and an opposing top, and further wherein the projection comprises a lip extending from the top of the each of the petals into the interior space.

6. The button of claim 5 wherein the button face comprises a perimeter sized and shaped to abut the sidewalls within the interior space.

7. The button of claim 5 wherein the button face further comprises a shoulder, the shoulder configured to abut the lip when the button face is secured to the housing.

8. The button of claim 1 wherein the stem is hollow.

9. The button of claim 1 wherein the upper portion of the housing is separated from the lower portion by a substantially cylindrical segment.

10. The button of claim 1 wherein the button face further includes at least one peg, the peg being received by the housing to secure the button face to the housing.

11. The button of claim 1 wherein the button face further includes a lobe, the lobe being received by the anchor to secure the button face to the anchor.

12. A reconfigurable button, comprising:

an anchor comprising a stem having a tip and a base and a flange extending radially outward from the base, the stem having sidewalls extending upward from the base to the tip, the sidewalls defining a channel, and further wherein the anchor comprises a projection extending from the tip and into the channel;

a housing having a lower portion mating with the anchor to retain a section of material therebetween, the housing further having an upper portion defining an interior space; and a button face having a lobe, the lobe being removably retained within the channel and engaging the projection to secure the button face to the anchor.

* * * * *